US005601691A

United States Patent [19]

Kufferath

[11] Patent Number: 5,601,691

[45] Date of Patent: Feb. 11, 1997

[54] MULTILAYERED PRESS SCREEN FOR WET PRESSES OF A PAPER MACHINE

[76] Inventor: Franz F. Kufferath, Lommessemstrasse 37, D-52353 Düren, Germany

[21] Appl. No.: 125,190

[22] Filed: Sep. 23, 1993

[30] Foreign Application Priority Data

Sep. 26, 1992 [DE] Germany ..... 42 32 319.3

[51] Int. Cl.[6] ..... D21F 3/00

[52] U.S. Cl. ..... 162/358.2; 162/900; 139/411; 442/195; 442/246

[58] Field of Search ..... 428/282, 357; 139/383 R, 411; 162/900, 358.2

[56] References Cited

U.S. PATENT DOCUMENTS

| | | | |
|---|---|---|---|
| 3,158,984 | 12/1964 | Butler | 139/425 |
| 4,162,190 | 7/1979 | Ashworth | 428/280 |
| 4,199,401 | 4/1980 | Liu et al. | 428/282 |
| 4,414,263 | 11/1983 | Miller | 162/900 |
| 4,503,113 | 3/1985 | Smart | 162/900 |
| 4,520,059 | 5/1985 | Worrall et al. | 428/109 |
| 4,555,306 | 11/1985 | Lundstrom | 162/900 |
| 4,633,596 | 1/1987 | Joset | 139/383 A |
| 4,705,601 | 10/1987 | Chiu | 162/348 |
| 4,799,998 | 1/1989 | Dutt | 162/900 |
| 4,815,499 | 3/1989 | Johnson | 139/383 A |
| 4,941,514 | 7/1990 | Taipale et al. | 162/901 |
| 4,943,476 | 7/1990 | Sokaris | 162/900 |
| 5,056,565 | 10/1991 | Kufferath . | |
| 5,097,872 | 3/1992 | Laine et al. | 139/426 R |
| 5,360,518 | 11/1994 | McCarthy et al. | 162/900 |
| 5,366,798 | 11/1994 | Ostermayer | 162/348 |

FOREIGN PATENT DOCUMENTS

| | | | |
|---|---|---|---|
| 1182317 | 2/1985 | Canada | 162/900 |
| 0146341 | 6/1985 | European Pat. Off. | 162/900 |

*Primary Examiner*—Brenda A. Lamb

*Attorney, Agent, or Firm*—Wigman, Cohen, Leitner & Myers, P.C.

[57] ABSTRACT

A multilayered press screen for wet presses of a paper machine exhibits a capillary and/or adhesive water reservoir that is integrated into the cloth at a distance from both the contact surface for the web to be dewatered and from the machine running side.

9 Claims, 1 Drawing Sheet

MULTILAYERED PRESS SCREEN FOR WET PRESSES OF A PAPER MACHINE

BACKGROUND OF THE INVENTION

The present invention relates to a multilayered press screen for wet presses of a paper machine.

The known press screens of this kind were developed in order to be able to replace the so-called press felts due to their shortcomings.

The present invention is based on the problem of improving the known press screens of the aforementioned kind.

SUMMARY OF THE INVENTION

The water reservoir integrated into the cloth of the press screen prevents, on account of its capillary and/or adhesive property, the water absorbed by the press band in the slot of a wet press from being dispensed prematurely after the press screen leaves the wet press by means of a so-called film splitting at a lead roller or the like or subject to the action of centrifugal force during rerouting, but rather it can be transported to a dewatering station formed, for example, by a pipe suction apparatus. A premature dispensing of water can lead to splattering and the formation of water vapor in the wet press, a state that can be disturbing due to the formation of droplets and the like during the production process.

In a preferred embodiment the water reservoir is formed by additional threads running in the cross direction of the screen and/or in the longitudinal direction of the screen. In such a construction these threads can be included in at least one of the layers of the screen or can also form an additional layer that is designed in such a manner preferably that it is highly capillary and has a highly wettable surface. Therefore, suitable water reservoirs are provided by means of, for example, multifilament yarns, staple fiber yarns, micro yarns, yarns in the titer range below 1 dtex, and also monofilament profiled fibers with raised surface. All of these threads can be very thin, because they are protected from abrasion from external forces on account of the distance both from the contact surface for the web to be dewatered and also from the machine bearing side. The threads of the water reservoir can be arranged in one or more weft layers and/or warp layers. Furthermore, it is not necessary to form the water reservoir exclusively from the multifilament yarns, staple fiber yarns and micro yarns. Monofilament and multifilament threads can also follow alternatingly in succession.

In a preferred embodiment the screen cloth is designed in such a manner that its permeability to water decreases in accordance with a double funnel from the contact surface for the web to be dewatered in the direction of the water reservoir, has its lowest value in the region of the water reservoir, and increases from here in the direction of the running side of the machine. Thus, the screen cloth achieves an especially high dewatering capacity, especially since the water reservoir counteracts, owing to its retaining power, a so-called rewetting of the web, i.e., dispensing water at web upon leaving the press slot.

The upper layer, against whose upper surface designed preferably so as to be monoplanar the web to be dewatered rests, has in an advantageous manner a dimensional stability that does not allow at a minimum any significant change in its hydraulic dewatering resistance under the pressure load in a press. Thus, it is guaranteed that the water pressed out of the web in the press slot is subjected to the lowest possible resistance to hydraulic dewatering, a feature that is important for the desorption of water in the press slot. In addition to the choice of a bonding for the upper layer that promotes dimensional stability, the upper surface is made, therefore, of pressure-resistant, monofilament threads. Instead of a round cross section, the longitudinal monofilament threads of the upper layer can also have a rectangular, oval or dumbbell-shaped cross section, whereby the specific pressure load on the monofilament threads can be changed and the effective contact surface for the web can be changed, for example, enlarged.

Another objective of the present invention is also to achieve dimensional stability for the bottom layer, so that the storage volume made available by the bottom layer is not significantly reduced in the press slot. The longitudinal threads of the bottom layer can also be made of pressure-resistant, monofilament threads with various cross sections, round, rectangular, oval, or dumbbell-shaped, cross sections. As in the case of the profiled threads and the effective running surface of the screen cloth can be modified.

If monofilaments are used for the threads of the water reservoir, it is expedient to provide the profiled threads with an enlarged surface compared to round threads. For example, threads having a star-shaped or cross-shaped cross section can be utilized in the present invention.

The water retaining power of the bottom layer can be increased, if desired, by weaving in twisted threads of monofilaments.

The monofilaments are made preferably of a plastic such as PA 6.12 or PA 6.10, which exhibits water absorption below 6%.

BRIEF DESCRIPTION OF THE DRAWINGS

The present invention is explained in detail in the following with reference to the embodiment shown in the drawings, wherein.

DETAILED DESCRIPTION OF THE PREFERRED EMBODIMENTS

A multilayered press screen, which bears, instead of a press felt, a web to be dewatered while travelling through a wet press of a paper or cardboard machine, is made of an upper cloth, all of which is denoted as 1 and whose upper side forms the contact surface for the web to be dewatered; a bottom cloth, all of which is denoted as 2 and which forms the machine running side of the press screen; and an intermediate layer 10, arranged between both upper and bottom cloth.

The upper cloth 1 is designed as one layer in the embodiment, but it can also be multilayered. In the case of a multilayered design the bottom layer adjacent to the intermediate layer 10 would be designed in such a manner that its resistance to hydraulic dewatering is greater than that of the upper layer. The side of the upper cloth 1 that forms the contact surface for the web to be dewatered is monoplanar.

So that the upper cloth 1 does not lose its openness and its resistance to hydraulic dewatering does not experience any significant change under the pressure load in a press, the upper cloth 1 is designed so as to be dimensionally stable.

For this purpose, an interlacing or binding with short flotation is selected. Secondly, both the weft threads 4 and the warp threads 5 are monofilament threads made of pressure resistant polymeric material, wherein not only those having a circular cross section but also those having enlarged surfaces, thus for example monofilament fibers with rectangular, oval or dumbbell-shaped cross section are suitable. By means of such cross sectional shapes the specific pressure load of the threads is reduced and the effective size of the contact surface for the web to be dewatered is raised.

Figure 1:
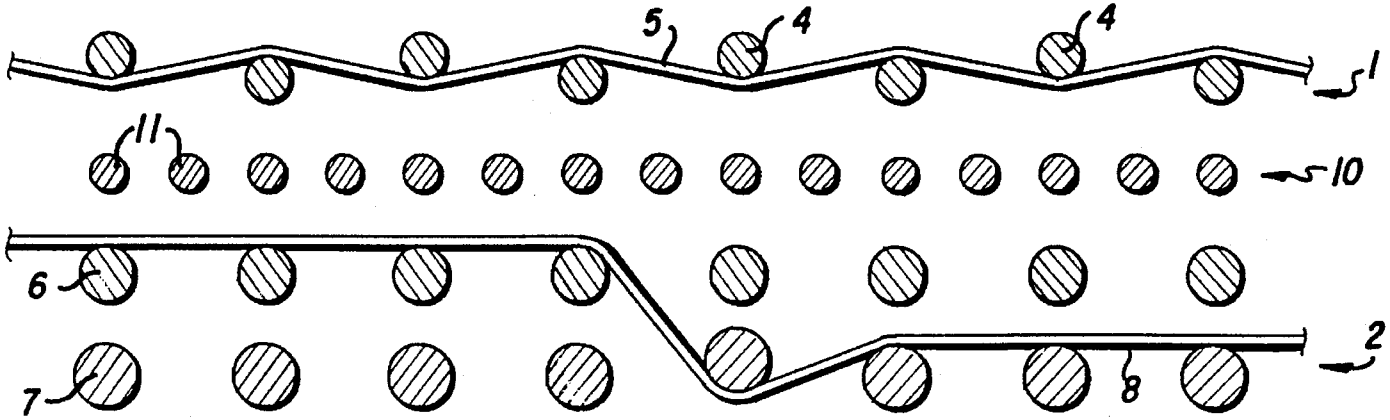
FIG. 1 is a diagrammatic view of the warp of the embodiment.
Figure 2:
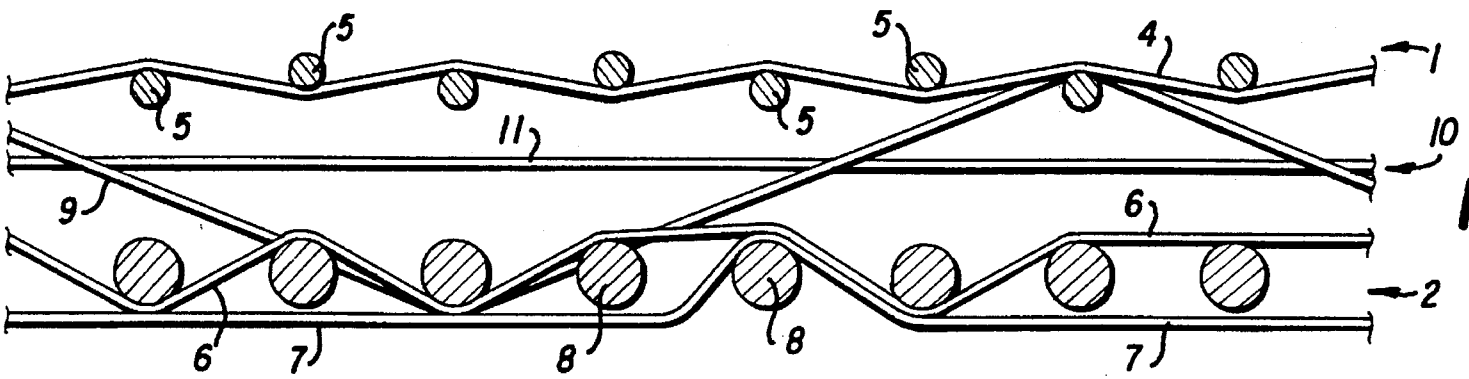
FIG. 2 is a diagrammatic view of the weft of the embodiment.

As shown in FIG. 1, the bottom cloth 2 exhibits an upper weft layer, made of face wefts 6, and a bottom weft layer, made of back wefts 7. Each of these back wefts 7 is oriented exactly relative to one of the face wefts 6. Warp threads 8 join in such a manner with the face wefts 6 and the back wefts 7 that the hydraulic dewatering resistance of the bottom layer of the bottom cloth 2 is less than that of the upper layer. In the embodiment, therefore, the binding of the warp threads 8 into the bottom layer is less than into the upper layer. In addition, the binding is chosen in such a manner that it facilitates the bottom cloth 2 achieving dimensional stability under the pressure prevailing in the slot of a wet press. First, the dimensional stability of the bottom cloth 2, which ensures that the space made available for the absorption of water is not significantly reduced in the press slot, is obtained by using monofilament threads. In so doing, these threads can have, instead of the round profile, a rectangular, oval or dumbbell-shaped cross section, thus reducing the specific pressure load on the threads and enlarging the effective machine running surface.

Between the upper cloth 1 and the bottom cloth 2, which are connected together by the binding wefts 9, there is the intermediate layer 10, which is made in the embodiment exclusively of weft threads 11, which are arranged in one single layer. Yet it is also possible to form the intermediate layer 10 of warp threads, wherein both the weft threads and the warp threads can be arranged in multiple layers. Furthermore, the intermediate layer 10 can be made of mono- or multi-layered cloth, thus both of weft threads and also warp threads.

In the embodiment all of the weft threads 11 are multifilament threads. If monofilament threads are also used, then monofilament and multifilament threads alternate in succession. Monofilament threads in the intermediate layer 10 act in a positive manner on the targeted incompressibility of the entire press screen.

The intermediate layer 10 is highly capillary and adhesive for water. Therefore, the intermediate layer 10 forms at a distance from the upper side of the upper cloth 1 that forms the contact surface for the web to be dewatered a water reservoir, which has a very low storage capacity, but does not dispense the water stored in it until there are very high forces. Therefore, the intermediate layer 10 effectively prevents the water absorbed by the press screen in the slot of a press from being dispensed prematurely after leaving the press slot, be it through centrifugal forces during rerouting by means of a guide roller, or be it through film splitting on a roller surface.

The intermediate layer 10, which has the effect of a compressed layer of cloth with an extremely high wettable surface and fine capillary mesh openings, has the highest hydraulic dewatering resistance. Therefore, the hydraulic dewatering resistance decreases from the upper side of the upper cloth 1 that forms the contact surface for the web to be dewatered in the direction of the intermediate layer 10, where it has its highest value and decreases again in the direction of the machine running side. Therefore, it is comparable to a double funnel. Correspondingly, the size of the openings intended for the dewatering operation decreases according to a double funnel from the contact surface for the web to be dewatered in the direction of the intermediate layer 10 and then increases again in the direction of the machine running side, thus the bottom side of the bottom cloth 2.

In the preferred embodiment described above the upper cloth 1 consists of twentysix weft threads 4 per centimeter and twentyeight warp threads per centimeter. Weft threads 4 have a diameter of 0,17 mm and warp threads 5 a diameter of 0,15 mm. The material of both kinds of threads 4 and 5 is PA 6.12. i.e. a polyamide.

In the bottom cloth 2 are used twentysix face wefts 6 per centimeter with a diameter of 0,35 mm, twentysix back wefts 7 per centimeter with a diameter of 0,40 mm and twentyeight warp threads 8 with a diameter of 0,25 mm. The material of all threads of the bottom cloth 2 is PA 6.12.

The intermediate layer 10 consists of twentysix multifile weft threads per centimeter with a dtex of 1450. dtex 1450 means that 10.000 m of this multifile weft thread have a weight of 1450 gramms. The material is PA 6. The binding wefts 9 have a density of 6,5 threads per centimeter. Their diameter is 0,13 mm and the material used for the binding wefts 9 is PA 6.12.

All threads have a circular cross-section.

Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A press screen for wet presses of a paper machine, comprising a plurality of woven layers, one of said layers having a water reservoir having capillary and adhesive water retention properties, said reservoir being integrated into said layer at a distance from both a contact surface for a web to be dewatered and from a machine running side of the screen, wherein the water reservoir is formed by additional threads running in a direction selected from the group of directions consisting of a cross direction of the screen and a longitudinal direction of the screen, and wherein the threads of the water reservoir form a woven layer of cloth having a high capillarity, said layer having a large wettable surface and a hydraulic dewatering resistance higher than any other layer.

2. A press screen, as claimed in claim 1, wherein said woven layer of cloth forming the water reservoir is integrated into at least one of the layers of the press screen.

3. A press screen, as claimed in claim 1, wherein the layer of cloth forming the water reservoir is arranged as an intermediate layer below an upper cloth.

4. A press screen for wet presses of a paper machine, comprising a plurality of woven layers, one of said layers having a water reservoir having capillary and adhesive water retention properties, said reservoir being integrated into said layer at a distance from both a contact surface for a web to be dewatered and from a machine running side of the screen, wherein the water reservoir is formed by additional threads running in a direction selected from the group of directions consisting of a cross direction of the screen and a longitudinal direction of the screen, and wherein the threads are selected from the group of threads consisting of monofilament threads and multi filament threads, said threads following alternatively in succession in the layer forming the water reservoir and wherein the water reservoir layer has a hydraulic dewatering resistance higher than any other layer.

5. A press screen for wet presses of a paper machine, comprising a plurality of woven layers, one of said layers having a water reservoir having capillary and adhesive water retention properties, said reservoir being integrated into said layer at a distance from both a contact surface tier a web to be dewatered and from a machine running side Of the screen, wherein a bottom cloth has a dimensional stability that does not allow at a minimum any significant change in hydraulic dewatering resistance thereof, wherein the threads of the water reservoir are monofilaments with a surface that is enlarged with respect to round threads and wherein said monofilaments have a cross section selected from the group of cross sectional shapes consisting of star-shaped and cross-shaped and wherein the water reservoir layer has a higher hydraulic dewatering resistance than any other layer.

6. A press screen for wet presses of a paper machine, comprising a plurality of woven layers, said press screen having a permeability to water, one of said layers having a water reservoir, said reservoir being integrated into said layer at a distance from both a contact surface for a web to be dewatered and from a machine running side of the screen, wherein the water reservoir is formed by additional threads running in a direction selected from the group of directions consisting of a cross direction of the screen and a longitudinal direction of the screen, and wherein the threads of the water reservoir form a woven layer of cloth having a high capillarity, said layer having a large wettable surface and wherein the permeability to water decreases in accordance with a double funnel from the contact surface for the web to be dewatered in the direction of the water reservoir, has the lowest value in the region of the water reservoir, and increases from the water reservoir in the direction of the running side of the machine.

7. A press screen for wet presses of a paper machine, comprising a plurality of woven layers, said press screen having a permeability to water, one of said layers having a water reservoir, said reservoir being integrated into said layer at a distance from both a contact surface for a web to be dewatered and from a machine running side of the screen, wherein the water reservoir is formed by additional threads running in a direction selected from the group of directions consisting of a cross direction of the screen and a longitudinal direction of the screen, and wherein the threads are selected from the group of threads consisting of monofilament threads and multifilament threads, said threads following alternatively in succession in the layer forming the water reservoir and wherein the permeability to water decreases in accordance with a double funnel from the contact surface for the web to be dewatered in the direction of the water reservoir, has the lowest value in the region of the water reservoir, and increases from the water reservoir in the direction of the running side of the machine.

8. A press screen tier wet presses of a paper machine, comprising a plurality of woven layers, said press screen having a permeability to water, one of said layers having a water reservoir, said reservoir being integrated into said layer at a distance from both a contact surface for a web to be dewatered and from a machine running side Of the screen, wherein a bottom cloth has a dimensional stability that does not allow at a minimum any significant change in hydraulic dewatering resistance thereof, wherein the threads of the water reservoir are monofilaments with a surface that is enlarged with respect to round threads and wherein said monofilaments have a cross section selected from the group of cross sectional shapes consisting of star-shaped and cross-shaped and wherein the permeability to water decreases in accordance with a double funnel from the contact surface for the web to be dewatered in the direction of the water reservoir, has the lowest value in the region of the water reservoir, and increases from the water reservoir in the direction of the running side of the machine.

9. A press screen, as in any one of claims 4–5 and 7–8 wherein the monofilament threads that are used are made of a polymeric plastic material, having a water absorption capacity of less than 6%.

* * * * *